US012330084B2

(12) United States Patent
Kelly et al.

(10) Patent No.: US 12,330,084 B2
(45) Date of Patent: Jun. 17, 2025

(54) ILLUMINATING ANIMATION DEVICE

(71) Applicant: LIGHTUPTOYS.COM LLC, Sellersburg, IN (US)

(72) Inventors: Joshua C. Kelly, New Albany, IN (US); Christopher D. Kelly, New Albany, IN (US); Max Armendariz Lalama, Sellersburg, IN (US)

(73) Assignee: LIGHTUPTOYS.COM LLC, Sellersburg, IN (US)

( * ) Notice: Subject to any disclaimer, the term of this patent is extended or adjusted under 35 U.S.C. 154(b) by 207 days.

(21) Appl. No.: 18/054,693

(22) Filed: Nov. 11, 2022

(65) Prior Publication Data

US 2023/0111031 A1 Apr. 13, 2023

Related U.S. Application Data

(63) Continuation-in-part of application No. 17/335,447, filed on Jun. 1, 2021, now Pat. No. 12,097,447.
(Continued)

(51) Int. Cl.
*A63H 33/22* (2006.01)

(52) U.S. Cl.
CPC ..... *A63H 33/22* (2013.01); *A63H 2200/00* (2013.01)

(58) Field of Classification Search
CPC ..... A63H 33/22
(Continued)

(56) References Cited

U.S. PATENT DOCUMENTS 1,485,641 A * 3/1924 Sparks ..... F21V 1/00 446/485
2,020,192 A 11/1935 Kingsbury
(Continued)

FOREIGN PATENT DOCUMENTS

JP H04-124199 U 11/1992
JP 2003-325213 A 11/2003
(Continued)

OTHER PUBLICATIONS

Official Communication and European Search Report dated Mar. 25, 2024 with respect to corresponding European application, EP 23208476.
(Continued)

*Primary Examiner* — Eugene L Kim
*Assistant Examiner* — Matthew B Stanczak
(74) *Attorney, Agent, or Firm* — Jessica C. Ronald; Scott R. Cox

(57) ABSTRACT

A device that creates animation via the illumination of various LEDs through a film into which an image is cut. The film includes an image cut therein. The device includes a housing with a housing compartment formed by the film connected to a base via a wall. Secured within the housing compartment is a divider, which divides the compartment into a first and second chamber. A printed circuit board is secured within the compartment and includes a first and second LED, wherein the first LED is secured within the first chamber and the second LED is secured within the second chamber. A microcontroller unit controls the illumination of the first and second LEDs in conjunction with sound either from a microphone or a speaker to animate the image cut into the film.

18 Claims, 11 Drawing Sheets

Related U.S. Application Data

(60) Provisional application No. 63/269,724, filed on Mar. 22, 2022, provisional application No. 63/263,994, filed on Nov. 12, 2021.

(58) Field of Classification Search
USPC ..... 446/485
See application file for complete search history.

(56) References Cited

U.S. PATENT DOCUMENTS 2,592,444 A * 4/1952 Matelena ..... G09F 19/18 353/74
2,883,114 A * 4/1959 Horvath ..... F21S 8/00 188/293
3,199,248 A 8/1965 Suzuki
3,258,006 A * 6/1966 Shriber ..... A61B 5/441 D24/231
3,791,068 A * 2/1974 Pietrowiak ..... A63H 3/006 446/485
3,973,840 A 8/1976 Jacobs et al.
4,802,071 A 1/1989 Schuster
4,828,527 A * 5/1989 Spector ..... A63H 3/28 446/302
4,840,602 A 6/1989 Rose
4,895,364 A * 1/1990 Martel ..... A63F 9/183 273/237
4,923,428 A 5/1990 Curran
6,068,536 A * 5/2000 Madland ..... A63H 3/365 446/337
6,322,420 B1 11/2001 Daniellian
6,341,882 B1 * 1/2002 Lin ..... A63H 3/006 101/406
6,392,963 B1 * 5/2002 McGinnis-Smith ..... G04C 17/0075 368/107
6,467,908 B1 10/2002 Mines et al.
6,478,448 B1 * 11/2002 Gary ..... F21V 33/0004 362/86
6,712,487 B2 * 3/2004 Liou ..... A63B 37/0003 362/555
6,789,932 B2 * 9/2004 Healy ..... A45C 15/06 362/234
6,814,470 B2 * 11/2004 Rizkin ..... F21V 7/04 362/240
7,188,976 B1 * 3/2007 Fung ..... F21V 17/04 362/255
7,204,618 B1 * 4/2007 Kuelbs ..... F21S 9/037 362/35
7,281,818 B2 * 10/2007 You ..... F21V 7/09 362/240
7,390,104 B2 * 6/2008 Coushaine ..... F21V 3/00 362/240
7,611,396 B2 * 11/2009 Schnuckle ..... G09F 15/0025 348/744
7,643,734 B2 * 1/2010 Wefler ..... A61L 9/037 392/390
7,909,468 B2 * 3/2011 Lloyd ..... G03B 21/06 353/50
8,157,417 B2 * 4/2012 Chen ..... F21V 13/04 362/240
8,210,894 B2 7/2012 Chan
8,256,904 B2 9/2012 Reichow et al.
8,491,148 B2 * 7/2013 Coushaine ..... F21V 31/00 362/267
8,647,167 B2 2/2014 Heilbron et al.
8,808,052 B2 8/2014 Yang
9,122,136 B2 * 9/2015 Tang ..... G03B 21/145
9,207,527 B1 * 12/2015 Shooshan ..... G09F 7/08
9,303,862 B1 * 4/2016 Rubinstein ..... F21V 19/0015
9,541,817 B2 * 1/2017 Moran ..... G03B 21/001
9,750,294 B2 9/2017 Sum
9,759,413 B2 * 9/2017 Lien ..... F21V 23/04
9,946,141 B2 4/2018 Sum
10,126,637 B2 11/2018 Sum
10,132,490 B1 * 11/2018 Olivero ..... F21V 33/0008
10,497,324 B2 12/2019 Heilbron
10,663,161 B2 * 5/2020 Susic, Jr. ..... F21S 9/035
10,674,588 B2 6/2020 Kelly et al.
10,720,031 B1 * 7/2020 Cronmiller ..... F21S 8/00
10,738,972 B1 8/2020 Kelly et al.
10,928,715 B1 2/2021 Zhang
10,982,826 B2 * 4/2021 Bihong ..... F21L 4/00
11,061,304 B2 7/2021 Barnett et al.
11,149,932 B1 * 10/2021 Kelly ..... F21V 23/0471
11,215,354 B1 * 1/2022 Descher ..... F21S 9/02
11,253,789 B2 * 2/2022 Johnson ..... A63H 3/006
11,274,707 B2 3/2022 Kelly et al.
11,435,056 B1 * 9/2022 Zhu ..... F21V 3/049
11,480,331 B1 * 10/2022 Mabe ..... F21V 33/008
12,085,269 B1 * 9/2024 Song ..... G03B 21/2013
2003/0189825 A1 10/2003 Tauch
2004/0007710 A1 * 1/2004 Roy ..... B44C 5/005 257/88
2006/0176703 A1 * 8/2006 Cayton ..... B44C 5/005 362/240
2006/0250789 A1 * 11/2006 Coushaine ..... F21V 15/01 362/157
2007/0121319 A1 * 5/2007 Wolf ..... A01M 1/2083 362/231
2007/0183144 A1 * 8/2007 Van Ulmer ..... B44C 5/005 362/184
2007/0190894 A1 8/2007 Grisoff
2007/0207697 A1 * 9/2007 Chin ..... G09F 19/08 446/175
2007/0229949 A1 10/2007 Suko et al.
2008/0084790 A1 * 4/2008 McKee ..... G04G 9/00 368/10
2008/0094857 A1 * 4/2008 Smith ..... F21V 23/003 362/649
2008/0143966 A1 * 6/2008 Mastrosimone-Gese ..... G03B 21/001 353/30
2008/0207083 A1 * 8/2008 Schnuckle ..... G09F 15/0025 348/744
2009/0122548 A1 * 5/2009 Dalsgaard ..... F21V 17/002 362/282
2010/0321938 A1 * 12/2010 Hu ..... A63C 17/223 362/234
2011/0151746 A1 * 6/2011 Rucker ..... A63H 3/28 446/297
2013/0040532 A1 * 2/2013 Khubani ..... A63H 3/02 446/369
2013/0223043 A1 * 8/2013 Ray ..... F21V 33/00 362/96
2014/0268861 A1 * 9/2014 Yang ..... F21V 21/14 362/555
2014/0273731 A1 * 9/2014 Hocherman ..... A63H 33/22 446/485
2014/0335757 A1 * 11/2014 Khubani ..... A63H 3/006 446/219
2015/0104997 A1 * 4/2015 Haut ..... A63H 33/22 446/484
2015/0147932 A1 * 5/2015 Vizcarra ..... G03B 21/145 446/72
2015/0159846 A1 * 6/2015 Hollinger ..... H05B 47/19 362/183
2015/0276178 A1 * 10/2015 Chien ..... G03B 21/001 362/95
2016/0018083 A1 1/2016 Kelly et al.
2016/0377271 A1 12/2016 Kelly et al.
2017/0307965 A1 * 10/2017 Sum ..... A63H 3/006
2018/0015378 A1 * 1/2018 Yarro ..... A63H 33/26
2018/0099226 A1 * 4/2018 Villano ..... F21V 1/146
2018/0181654 A1 * 6/2018 Young ..... A63B 43/06
2018/0187876 A1 * 7/2018 Sutton ..... F21V 23/04
2018/0224729 A1 8/2018 Sum
2018/0270931 A1 * 9/2018 Kelly ..... H05B 33/12
2019/0118110 A1 4/2019 Starling
2019/0226652 A1 * 7/2019 Chien ..... F21V 15/01

(56) References Cited

U.S. PATENT DOCUMENTS

| | | | | |
|---|---|---|---|---|
| 2019/0239613 | A1* | 8/2019 | Noguera Ramis | A45C 13/08 |
| 2019/0327957 | A1* | 10/2019 | Wessel | F21V 33/008 |
| 2020/0124262 | A1* | 4/2020 | Paris | F21V 23/0485 |
| 2020/0238184 | A1* | 7/2020 | Johnson | A63H 3/006 |
| 2020/0393102 | A1* | 12/2020 | Huang | F21V 23/004 |
| 2021/0332858 | A1* | 10/2021 | Kelly | F16D 7/021 |
| 2022/0049842 | A1* | 2/2022 | Kelly | F21V 23/003 |
| 2022/0072439 | A1* | 3/2022 | Lo | A63H 33/26 |
| 2022/0168662 | A1* | 6/2022 | Kelly | A63J 5/028 |
| 2022/0221145 | A1* | 7/2022 | Parker | F21V 3/00 |
| 2022/0379232 | A1* | 12/2022 | Kelly | A63H 33/28 |
| 2023/0111031 | A1* | 4/2023 | Kelly | A63H 33/22 446/219 |
| 2023/0204188 | A1* | 6/2023 | Colquhoun | A63H 3/006 362/175 |
| 2023/0253004 | A1 | 8/2023 | Markovic | |
| 2023/0277953 | A1* | 9/2023 | Kelly | A63H 33/22 446/15 |
| 2023/0277954 | A1* | 9/2023 | Kelly | A63H 33/22 446/15 |
| 2024/0058715 | A1* | 2/2024 | Kelly | A63H 27/10 |
| 2024/0066424 | A1* | 2/2024 | Kelly | A63H 33/28 |
| 2024/0149226 | A1* | 5/2024 | Kelly | B01F 23/232 |

FOREIGN PATENT DOCUMENTS

| | | | |
|---|---|---|---|
| JP | 2008-125718 | A | 6/2008 |
| JP | 2008-259601 | A | 10/2008 |
| KR | 20180057963 | A | 5/2018 |

OTHER PUBLICATIONS

Disney Mickey Mouse Projection Musical Light String, item/article # 220551; 2021.

English Translation of Official Communication Report dated Oct. 15, 2024 with respect to corresponding Japanese application, JP 2023-190581.

* cited by examiner

ILLUMINATING ANIMATION DEVICE

CROSS-REFERENCES

This application is a continuation-in-part of and claims the benefit of U.S. application Ser. No. 17/335,447 filed on Jun. 1, 2021 and further claims priority from provisional application Ser. No. 63/263,994, filed Nov. 12, 2021 and 63/269,724 filed on Mar. 22, 2022. All publications, patents and patent applications referred to herein are incorporated by reference in their entirety.

FIELD OF INVENTION

The present invention relates to a toy that illuminates through a film to produce an animation. More particularly, the illumination is sound activated, so the animation is produced in concert with the sound.

BACKGROUND OF THE INVENTION

Devices that use light emitting diodes ("LEDs") located within various chambers of a device to produce an animation exist. However, these devices do note create a clear image when the animation is produced. Moreover, these devices are not capable of being easily secured into different toys. Moreover, these devices do not have interchangeable films with differing images that produce a variety of animations.

Furthermore, devices that illuminate in synchronization with a song exist. However, these devices are significantly limited in use as the synchronization of the LEDs with the song is preprogrammed into an integrated circuit within the device. Accordingly, the devices are not sound activated via ambient sounds detected by the device. Moreover, these devices do not store the sounds that are detected in a memory of the device for later use and activation. Thus, there is little versatility with these existing devices.

SUMMARY OF THE INVENTION

A device that creates animation via the illumination of various LEDs through a film into which an image is cut. The film includes an image cut therein. The device includes a housing with a housing compartment formed by the film connected to a base via a wall. Secured within the housing compartment is a divider, which divides the compartment into a first and second chamber. A printed circuit board is secured within the compartment and includes a first and second LED, wherein the first LED is secured within the first chamber and the second LED is secured within the second chamber. A microcontroller unit controls the illumination of the first and second LEDs in conjunction with sound detected by a microphone from the environment or from a speaker to animate the image cut into the film. The illumination of the LEDs is also activated in concert with sounds emanated through the speaker via sequences that are preprogrammed into the microcontroller unit.

DETAILED DESCRIPTION

Figure 1:
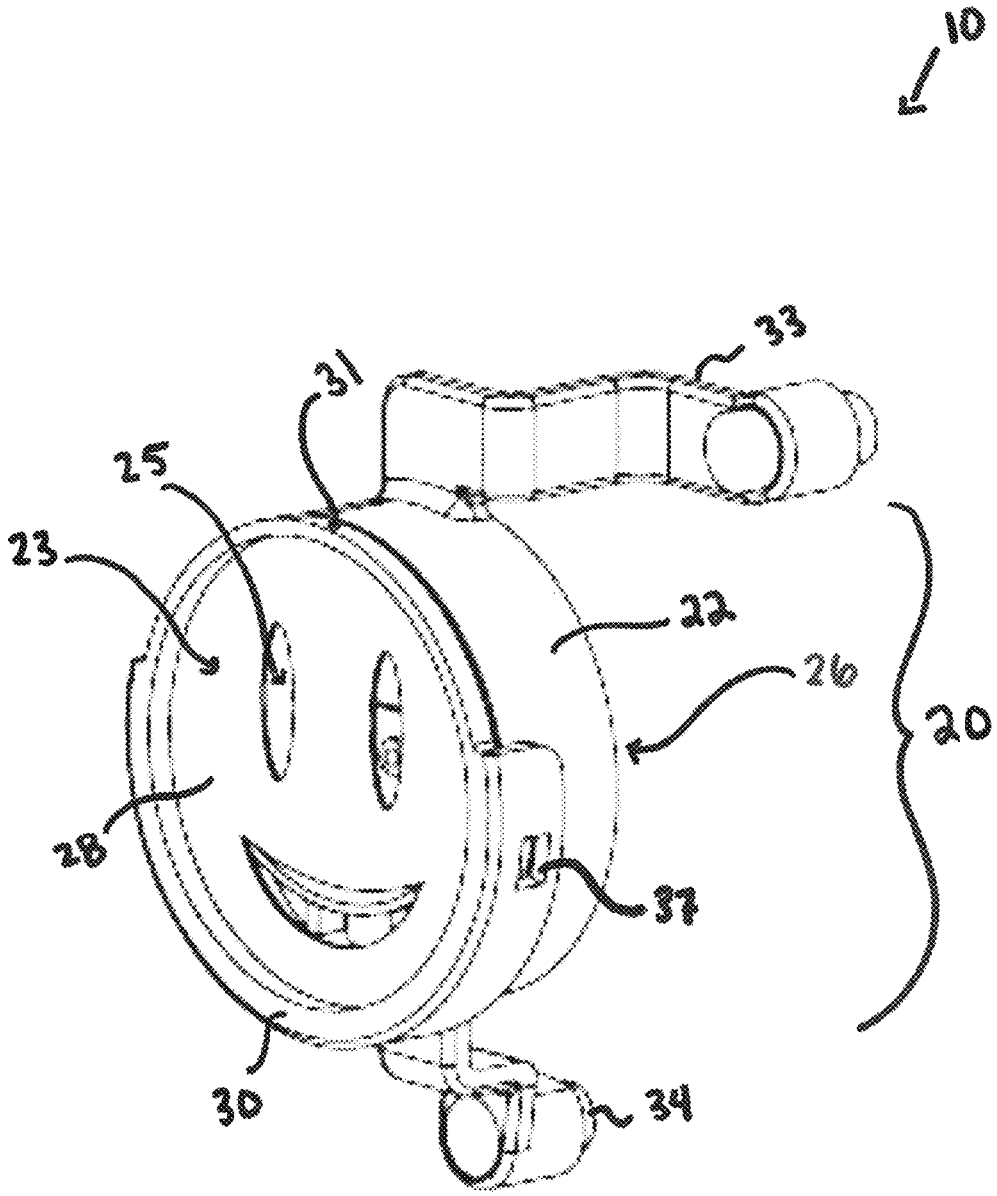
FIG. 1 is a side, perspective view of one embodiment of an illuminating animation device.
Figure 2:
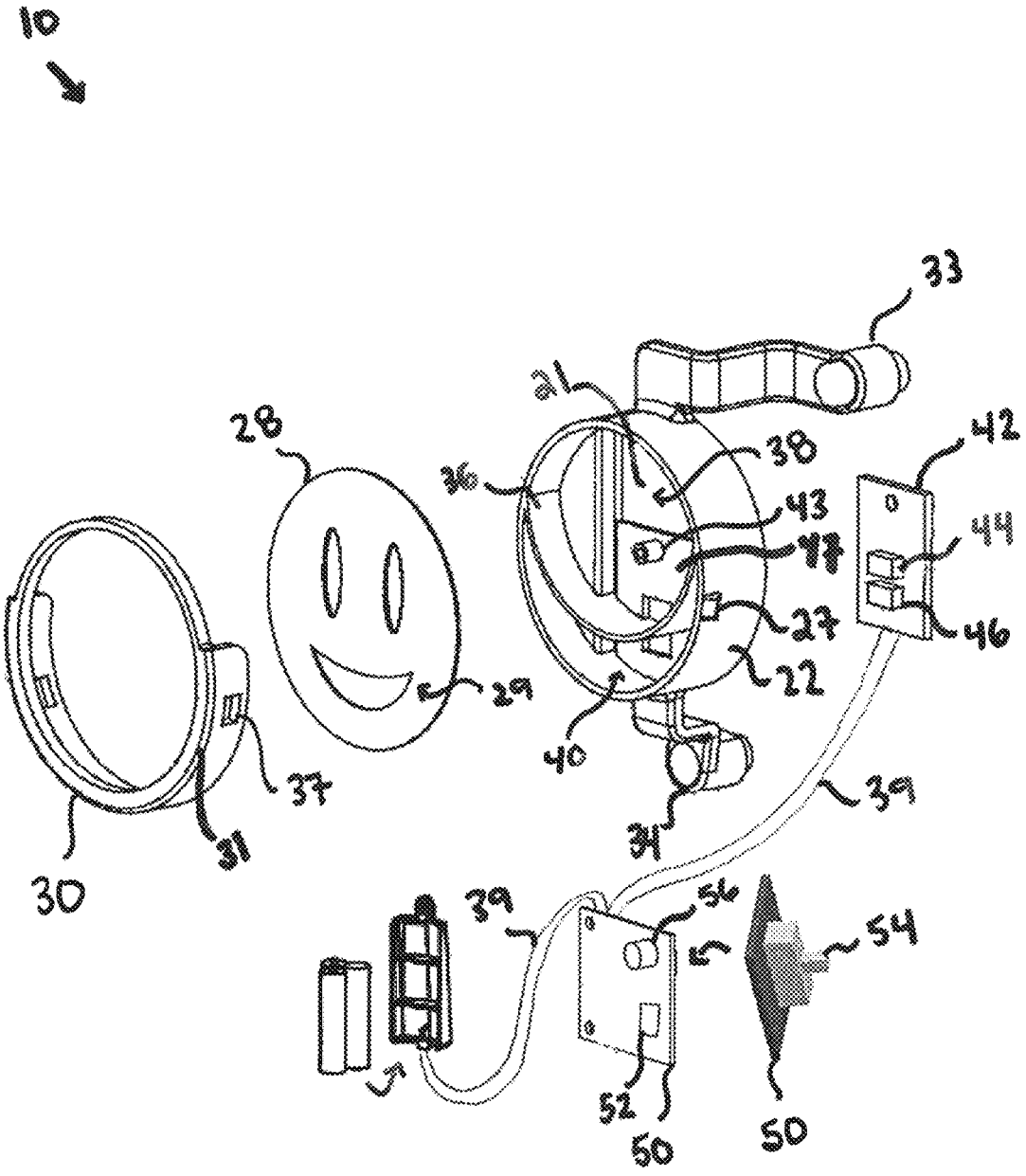
FIG. 2 is a side, perspective, exploded view of the illuminating animation device of FIG. 1.
Figure 3:
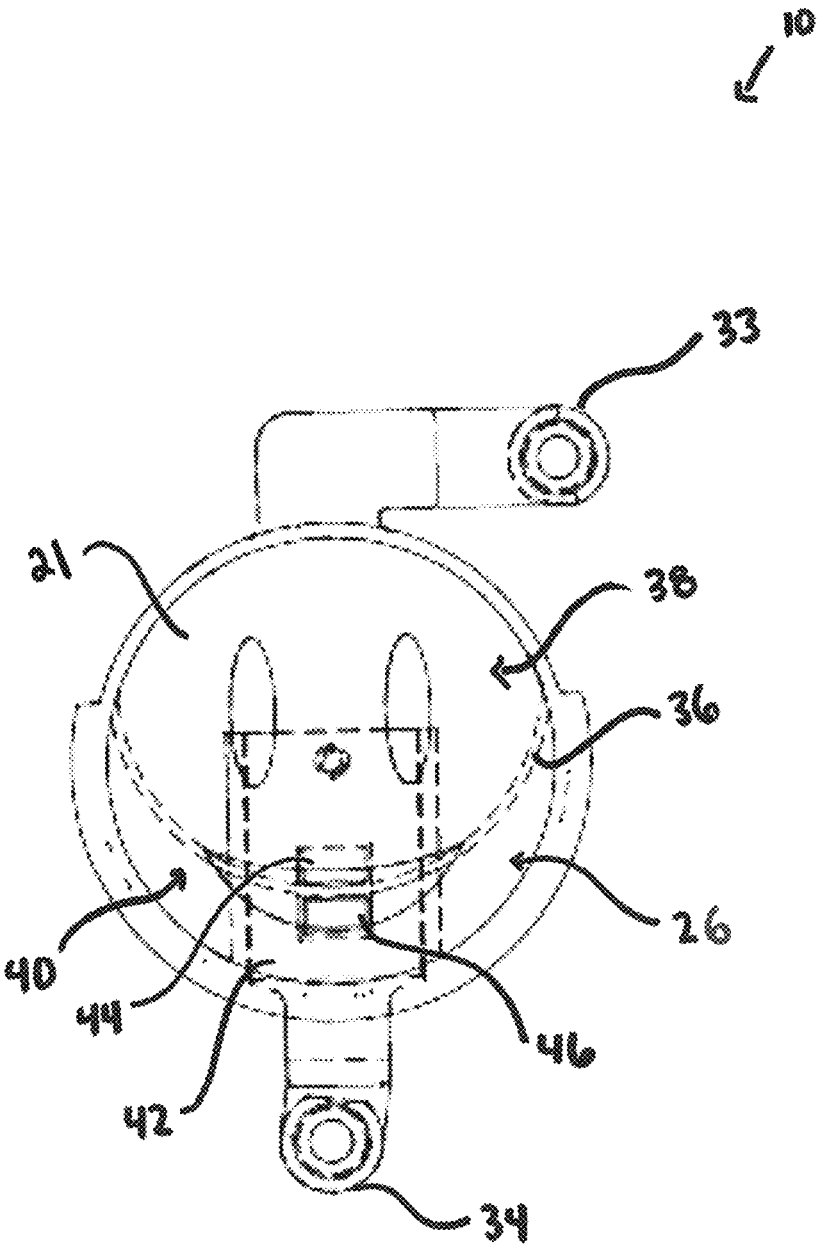
FIG. 3 is a back, transparent view of the illuminating animation device of FIG. 1.

FIGS. 1-3 show an illuminating animation device 10 and FIGS. 4*a*, 4*b* and 5-9 show various toys into which the illumination animation device is secured. These toys should not be construed as limiting as the animation device advantageously secures into or onto any structure. As shown in FIGS. 1-3 and 5-6, one way in which the device secures into or onto other structures is via a bracketing system that includes an upper 33 and lower bracket 34, which are secured to or soldered to the outside surface of a wall 22. The device is securable by any suitable methods specific to the toy into which it is being secured, for example, via screws or glue. One of ordinary skill in the art would understand that the features described herein for the stand-alone animation device are interpreted as applying to the embodiments of the animation device when it is secured into or onto other structures. While certain features or elements may be rearranged when the device is secured into or onto other structures, for example, the location of a power supply, the disclosures herein shall be understood to apply to all embodiments, particularly the electronic capabilities and features of the device.

As shown in FIGS. 1-3, the illuminating animation device 10 includes a cylindrically shaped housing 20, which includes a cylindrically shaped cover 30 secured to a front face 23 thereof and a cylindrically shaped base 21 secured to a back face 26 thereof. In between the cover and the base is a cylindrically shaped wall 22 that extends from the base to the cover. The extension of the wall between the two faces forms a housing compartment 25 where various internal components of the device are secured. The cylindrically shaped cover includes a slot 31 therein, which tightly fits a film 28 when slide therein.

As shown in FIGS. 1-3, particularly FIG. 2, the device 10 includes the cover 30, which is secured around the front face 23 of the device to the wall 22. As shown in FIGS. 1-2, the cover includes notches 37, which correspond with clasps 27 that form a part of the wall, so the cover easily snaps onto the wall. The cover includes a slot 31 into which the film 28 snuggly fits. For example, as shown in FIG. 2, the cover is generally open so when the film is positioned into the slot, the film encompasses the central opening of the cover. Advantageously, the film is tightly secured within the cover so when the device is flipped upside down, the film does not slide out. Further, the film is easily removeable and interchangeable with different films with different images. The film is, for example, an opaque black with a matte finish acetate sheet with an image die cut onto the film. In this embodiment, the film includes a first image 29 carved therein, which is a smiley face with two eyes and a mouth. Any image can be carved or cut into this film depending on user specification. Further, if desired, the film forms the outermost portion of the front face and includes a securing mechanism to connect to the wall (see FIG. 11).

As shown in FIGS. 1-3, particularly FIG. 2, the wall 22 extends from the base 21 to the cover 30 and forms a housing compartment 25 where various internal components are secured. The housing compartment is divided into a first chamber 38 and a second chamber 40 via a chamber divider 36. The divider is secured or soldered onto two opposing inside surfaces of the wall. As the first image 29 is a smiley face, the divider is curved to correspond with the u-shape of the mouth. The divider is advantageously located so that any image containing a mouth will benefit from the desired animation effect, i.e., that the device is talking (See animated images 12, 14 in FIGS. 4*a* and 4*b*). The number of chambers varies depending on the image that is etched into the film 28, the size of the device 10 and/or the desired animation effect. As shown in FIG. 3, the film is secured adjacent to the first chamber and second chamber so that the eyes and an upper portion of the mouth are aligned within the first chamber and a lower portion of the mouth is aligned within the second chamber. This specific positioning of the first image adjacent to the first and second chambers aids in producing the desired talking animation effect of the first image (see animated images in FIGS. 4*a* and 4*b*).

As shown in FIGS. 2-3, the first chamber 38 has a first LED 44 secured therein and the second chamber 40 has a second LED 46 secured therein. The LEDs are one color and/or vary in color and/or luminosity. The number of LEDs varies depending on factors such as the number of chambers present in the housing 20, the image carved into the film 28 and the desired animation effect. Both LEDs are secured and electrically connected to a printed circuit board ("PCB") 42, which PCB is secured within the back face 26 of the housing, for example via screws 43. As shown in FIG. 2, the base 21 of the device is manufactured to include a compartment 47 into which the PCB and LEDs secure. The LEDS are secured to the PCB using surface mounting technology. Advantageously, the inventors discovered the precise distance that the first and second LEDs should be secured from the film to produce a clear animation image, regardless of whether it is being projected onto or into another surface. Specifically, the distance from the LEDs to the film is important to control the size and location of the image that is projected through the film so that a clear, readable image is produced. The distance from the LEDs to the film is from about 5 mm to about 15 mm and creates a crisp, precise animated image that is easily recognizable to the eye.

Figure 4A:
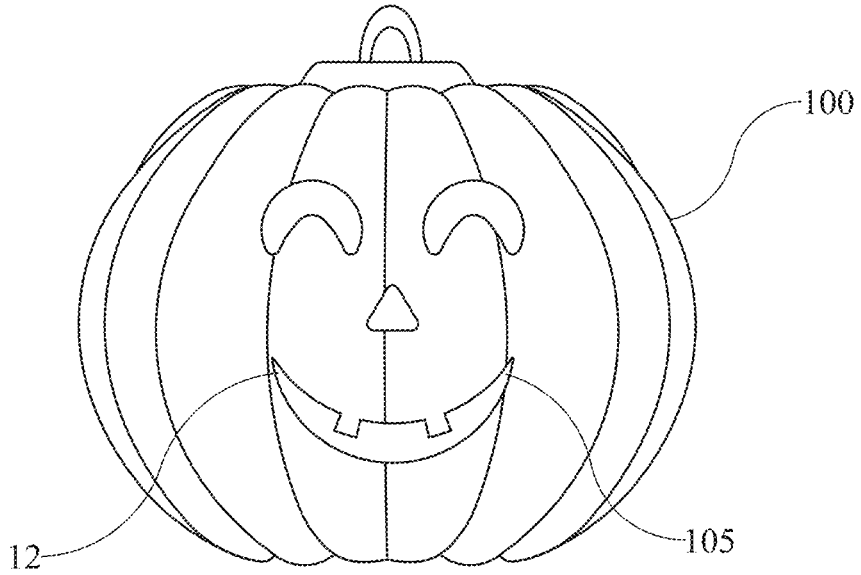
FIG. 4*a* is a front view of the illumination animation device of FIG. 1 secured within a pumpkin enclosure, which shows a first animated image.
Figure 4B:
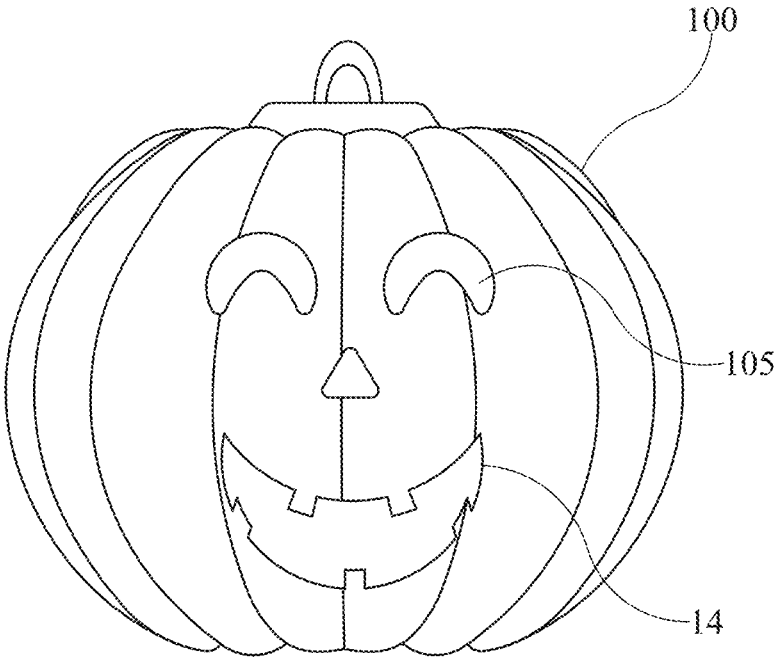
FIG. 4*b* is a front view of the illumination animation device of FIG. 1 secured within a pumpkin enclosure, which shows a second animated image.

However, in other embodiments, this distance varies depending on the apparatus into which the device is secured, the size of the device, the number of LEDs, and the image that is etched into the film. For example, when the device 10 is secured into an enclosure 100, 101, 114, such as shown in FIGS. 4*a*, 4*b*-6 and 9, the image cut on the film magnifies when illuminated onto an inside surface of the closure so the image 29 appears larger than the size of the film when it is projected thereon. As shown in FIGS. 4*a* and 4*b*, the device is secured within the enclosure and is smaller in size than the enclosure. However, since the device is also located at the precise distance from the inside of the enclosure, the face projected onto the inside surface of the enclosure appears much larger through the front face of the enclosure, while also being legible. The enclosure is the precise opacity that the light refracts through the enclosure and is clearly visible. For example, as shown in FIGS. 4*a*, and 4*b*, the mouth appears to be speaking based on the illumination of the first and second LEDS. Moreover, to aid in producing a desired animation effect, the enclosure includes a silhouette of a face 105, on the front face of the enclosure. Accordingly, when the face is projected through the film onto the silhouette, the animated image is magnified and aligns perfectly with the silhouette. This advantageously creates the illusion of a larger face, than is the size of the face present on the film.

Figure 11:
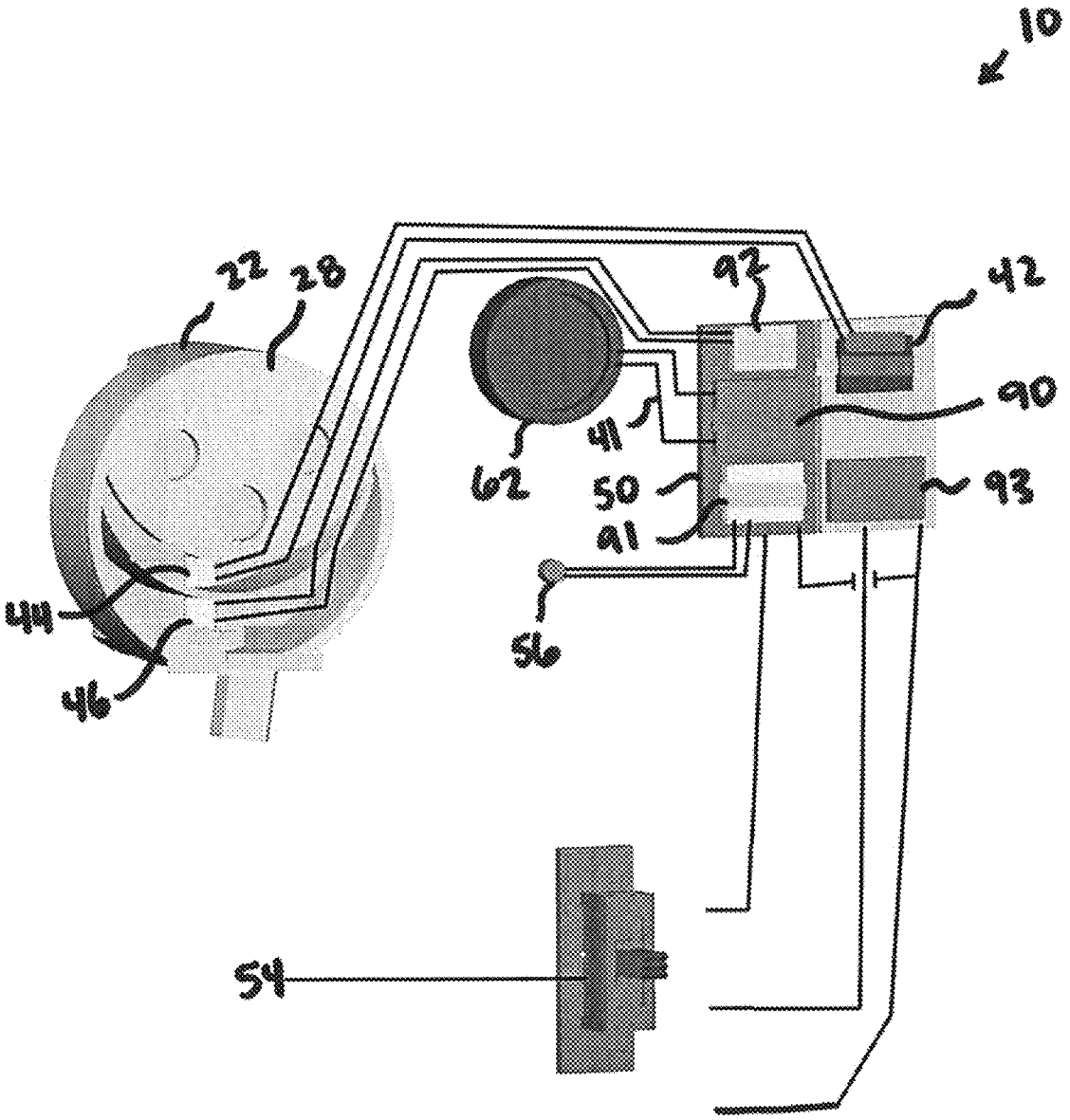
FIG. 11 is a partially exploded view of the illuminating animation device of FIG. 1, wherein a microcontroller unit includes various additional electronic features.

FIGS. 2 and 11 show different embodiments of the microcontroller unit 50 of the device 10. The orientation and combination of these various capabilities of the microcontroller unit should not be construed as limiting. The microcontroller or PCB combine all features and structures/electronics/circuits. In other implementations, such features are separately implemented. The PCB 42 is electrically connected via wiring 39 to a microcontroller unit 50, which includes various control circuitry. Such circuitry, for example, includes an integrated circuit chip 52, a microphone 56, and a switch 54. The switch is located on an opposite side of the microcontroller unit than the microphone and other control circuitry. The circuitry is used to control the desired animation effect and other features of the toy, such as sound, functional control of the LED intensity, color temperature, color, illumination duration and timing. Such circuitry also controls various other features when the device is secured into other toys, such as control of bubble production for the bubble producing toy 110 shown in FIG. 6. In some embodiments, the control of the light patterns of the first and second LEDs 42, 46, and/or other LEDs present is random or regular, or they are controlled in continuous sequence or pattern, a custom sequence or pattern, and/or sequence or pattern that incorporates constant timing, variable timing, and/or dimming.

As shown in FIG. 11, in one embodiment, electrically connected to the microcontroller unit 50 via wiring 41 is a speaker 62 other audio device, and/or a vibrating device. The microcontroller unit further includes an amplifier 90, a receiver 91 a relay 92 and a media player 93. Accordingly, such circuitry also includes control modulation such as, for example, frequency or amplitude modulation.

As shown in FIGS. 2 and 11, the microcontroller unit 50 includes a switch 54 and/or another circuit activating or deactivating the device. The switch or other circuit for activating or deactivating the device is mechanical, such as a toggle switch, depression switch, multi-position switch, such as a three-position switch and other similar mechanical activation assemblies. In one embodiment, the switch or other circuitry incorporates activation through embedded instructions and or receipt of activation signals received by the circuitry. For example, the microcontroller includes a receiver 91 for receiving signals which activate the illumination, sound or vibrational features of the device and/or other features of the device. The switch or other circuit, for example, incorporate proximity detection devices, such as for example RFID or other types of electronics which sense location, proximity or other wireless instructions which indicate and/or instruct illumination, sound and/or vibrational activation. Such device, for example, include instructions and circuitry operable to detect location in respect to a transmitted beacon. For example, the device automatically activates upon nearing a display, feature, attraction or other location within an amusement park which is transmitting a unique beacon which, when received by the device, causes the device to illuminate and/or play sound and/or activate in a predetermined manner.

Moreover, the device 10 includes a sound chip and/or media player 93, that includes various prerecorded or preprogrammed sounds or audio or video files. These sounds are preprogrammed with the illumination of the LEDs so that when the device, for example, nears a display, the prerecorded sound plays from the speaker and the LEDS 44, 46 illuminate accordingly so that the animation appears to be talking and blinking. Other automated instructions are further implemented such as emitting colors, playing predefined audio stored in memory of the device or received by the receiver of the device, playing signals which are streamed and received by the integrated receiver, and similar functionality. For example, the device includes a proximity detection which includes a blu-tooth beacon receiver. Upon receipt of a unique beacon signal, the device is programmed by instructions stored in memory to activate in a particular manner and/or play specific prerecorded or streamed audio signals, which are programmed with illumination of the LED so that the mouth appears talking in synchronization with the song or sound playing. Alternatively, the device incorporates RFID detectors wherein the device, upon recognition of a specific RFID signal, begins emitting a predetermined sequence of signals. Other implementations may be implemented such as GPS location detection and determination.

The illumination of the first and second LEDs 44, 46 and/or other LEDs present within the device are independently activated and/or illuminated via sound activation. For example, when the microphone 56 detects sounds, it transmits this signal to the PCB 42 and activates the LEDs to move via ambient sound detected in the environment. The integrated chip 52 controls the LEDs and coordinates the lights to the ambient sound detected. Furthermore, the sound activation is via the speaker 62, which plays audio and/or sound that is stored in a sound chip within the device. The microphone is activated by the sound played through the speaker, which initiates the sound activated illumination of the LEDs. In addition, the speaker may have prerecorded or programmed songs or audio to which the LEDs are preprogrammed to illuminate. Accordingly, the device animates in synchronization with the sound played through the speaker. Further, with the switch 54 being multi-way switch, one mode option for the device includes the microphone turned off, which the speaker is on. The light animation function of the LEDs, such as the second LED illumination, is preprogrammed to play in accordance with the sound file.

For example, in use, the switch is a multi-way switch, for example a two-way switch. When a user pushes the switch and/or when the switch is remotely activated, the first LED 44 that is secured within the first chamber 38 remains constantly illuminated. Therefore, the portion of the first image 29 that is illuminated via the first chamber, i.e., the eyes and top portion of the mouth are constantly illuminated. The second LED 46 secured within the second chamber 40 is not constantly on and is programmed to be sound activated via the circuitry of the microcontroller unit 50 and the PCB 42. The sound activation is either through diction through the microphone 56 via ambient sounds and/or sounds emanated from the speaker 62 or via programmed sequences. Therefore, the portion of the first image that is illuminated via the second chamber, i.e., bottom portion of the mouth illuminates on and off, so the mouth appears to be talking in synchronization with a sound (see the first animation image 12 in FIG. 4*a* in comparison to the second animation image 14 in FIG. 4*b*). The illumination of the first and second LEDs should not be construed as limiting as they can both activate and deactivate depending on signals received from the PCB. For example, the first LED illuminate so the device appears to be blinking.

If the switch is for example a three-way slide switch, when the switch turned to right it is in an infrared mode. The device 10 receives a signal from a transmitter(s) to unlock an audio file stored within a sound chip in the device. There are several audio files stores, for example five, which are prerecorded and preprogrammed in the sound chip. When the user interacts with a transmitter, it unlocks a specific stored audio, which activates the illumination of the LEDs (44, 46) and/or other LEDs of the device in a preprogramed way so that the device is animated to talk in sync with the sound or audio. The microphone is turned off, so the LEDs react to prestored audio and the second LED flashing or illuminating sequence is pre-programmed according to each audio file to create talking animation. Advantageously, the device appears to be talking or singing a song as the microphone is turned off, so it is not sound activated by any environmental noises. When the switch is turned to the left, the microphone is active, so the illumination of the LEDs is sound activated by environmental noises. Further, in one embodiment, the device includes numerous other LEDs within the device, so in addition to the talking animation, there is a unique light show that is activated when a user holds down the switch. In one embodiment, the device further includes a push button, which unlocks the stored memory feature of the device, which replays and cycle through unlocked audio file.

Figure 10:
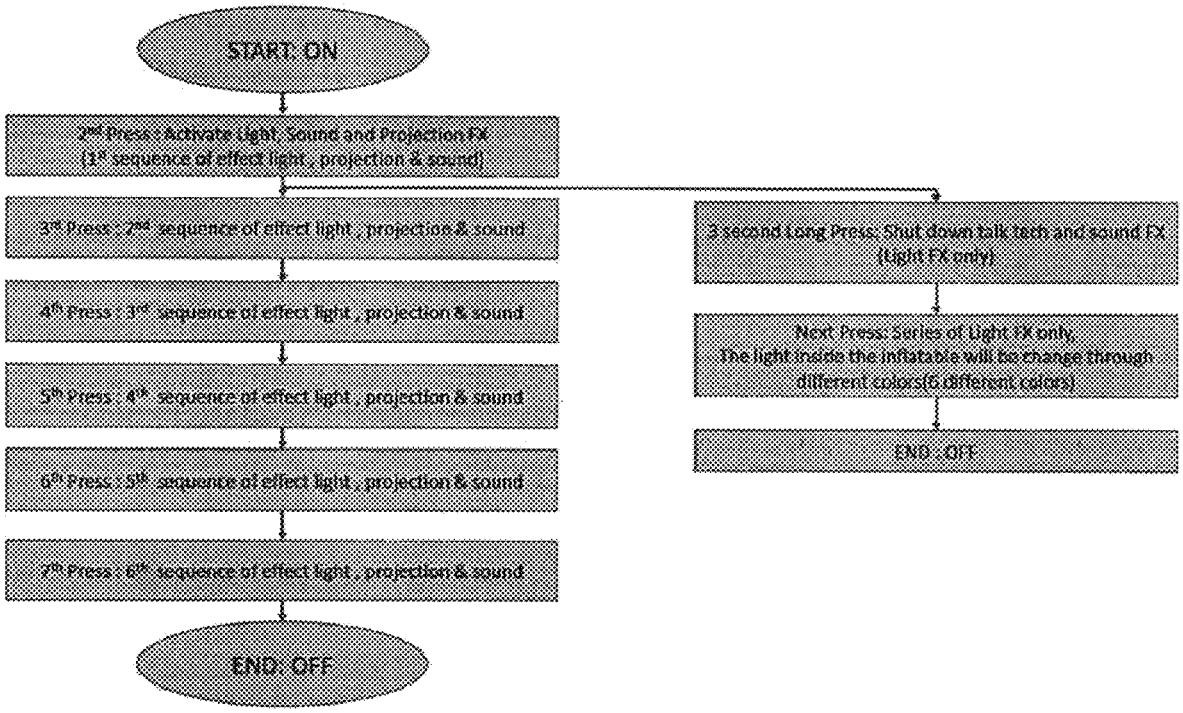
FIG. 10 is a flow chart demonstrating one embodiment of the electronic capabilities of the illuminating animation device securable within the inflatable balloon toy shown in FIG. 7.

In another embodiment, for example, in addition to the switch 54, the device includes a button and various LEDs in addition to the first and second LEDs (44, 46). When the user presses the button, the light, sound and projection of the device is automatically activated. Continuously pressing of button cycles through a variety of different light effects, projection and sound effects (see flow chart of FIG. 10). The effects automatically turn off after flashing through the different effects. In addition, anytime the user presses the button for a set period or time, for example, around three seconds, the mode of the device changes. For example, the colors or the LEDs change, or the microphone turns off, etc.

In one embodiment, the device 10 includes an interactive hub containing a walkie talkie. The microphone of the walkie talkie picks up the sound emitted from a nearby smart device, which is encoded onto a radio frequency and transmitted via an antenna of the walkie talkie to a walkie talkie that is secured within a toy. This signal is decoded from the radio signal and drives a speaker within the toy. The toy further includes a microphone, which detects the sound and sends a signal to an integrated circuit, which controls the illumination of various LEDs secured within the toy. The LEDs illuminate in synchronization with the sound to animate a face on a surface of the toy, so the toy appears to be talking.

Figure 5:
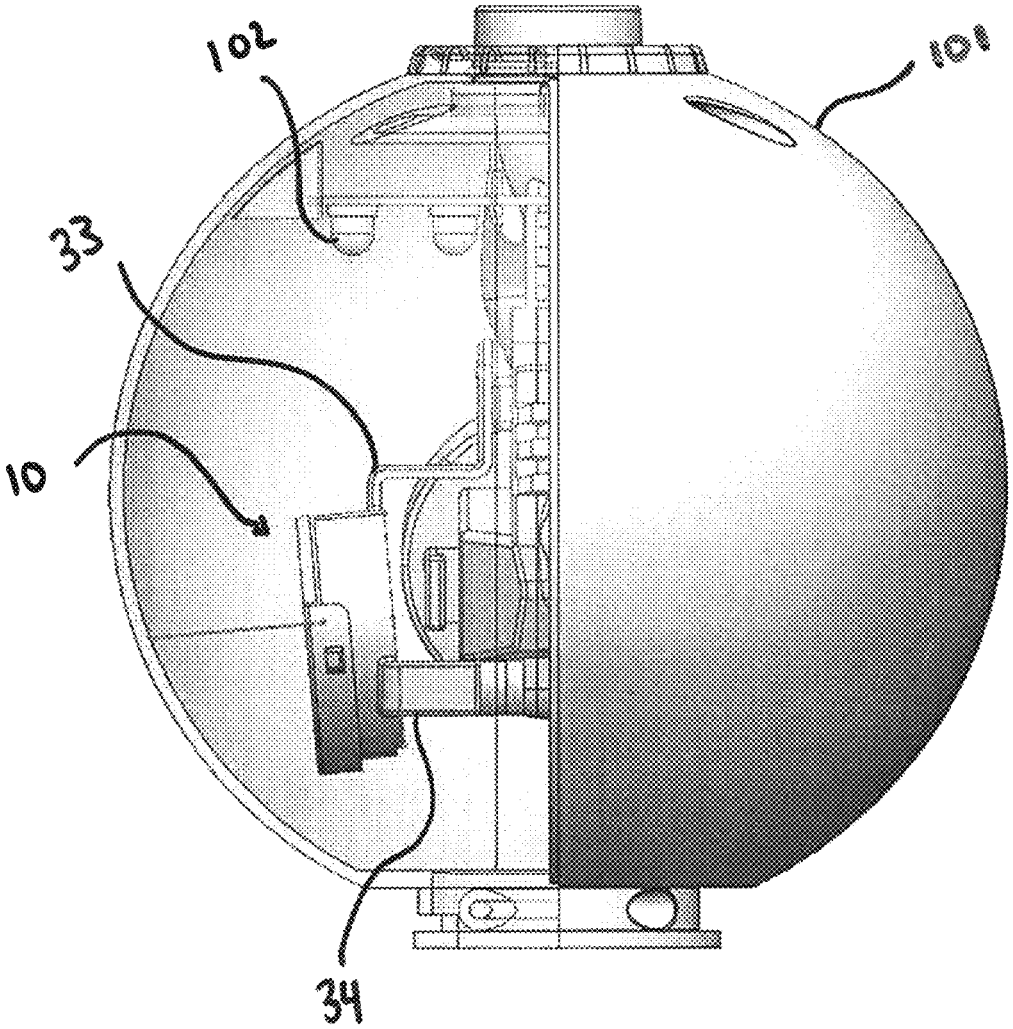
FIG. 5 is a side, partially open view of the illumination animation device of FIG. 1 secured within a globular enclosure.

Advantageously, the device 10 is easily secured into or onto anything. For example, as shown in FIGS. 4*a*-6 and 9, the device is bracketed inside further enclosures 100, 101, 114. This enclosure is for example made of a thermal plastic material such as acrylonitrile butadiene styrene and is around about 50-80% opacity, preferably about 70% opacity. This enclosure is white or beige to better reflect the images produced by the illumination of the film 28. This opacity is ideal as it reflects the ideal amount of light onto the inner surface of the enclosure and allows light to project therethrough, so the animated image is visible. The image cut on the film magnifies when illuminated so the image 29 appears larger than the size of the film when it is projected onto an inside surface of the enclosure. Moreover, to aid in producing a desired animation effect, the enclosure includes a silhouette 105 of a face, for example, onto which the illumination through the film projects and is magnified. This advantageously creates the illusion of a larger face, than is the size of the smiley face present on the film. Further, as shown in FIG. 5, the enclosure includes various LEDs 102 that illuminate in coordination with the device to create an animated light show.

Figure 9:
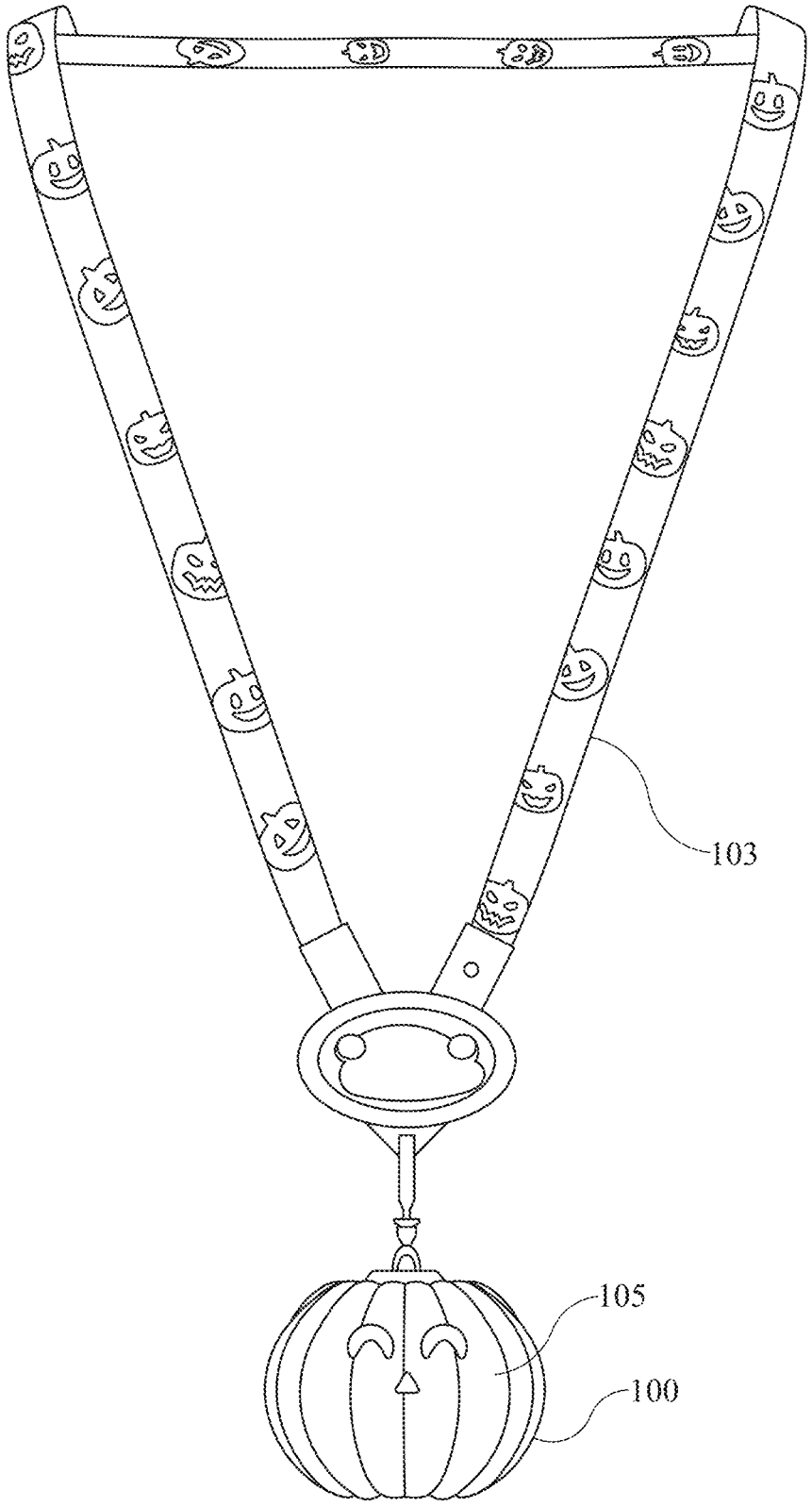
FIG. 9 is a front view of the illuminating animation device of FIG. 1 secured within a pumpkin enclosure and affixed to a lanyard.

As shown in FIG. 9, the device 10 is worn by a user, for instance around their neck via a lanyard 103 or on a wristband. Moreover, in another embodiment, the device includes a magnet secured to the base 21, which is attracted to a free-standing magnet. The device is, therefore, securable around a user's clothing.

Figure 6:
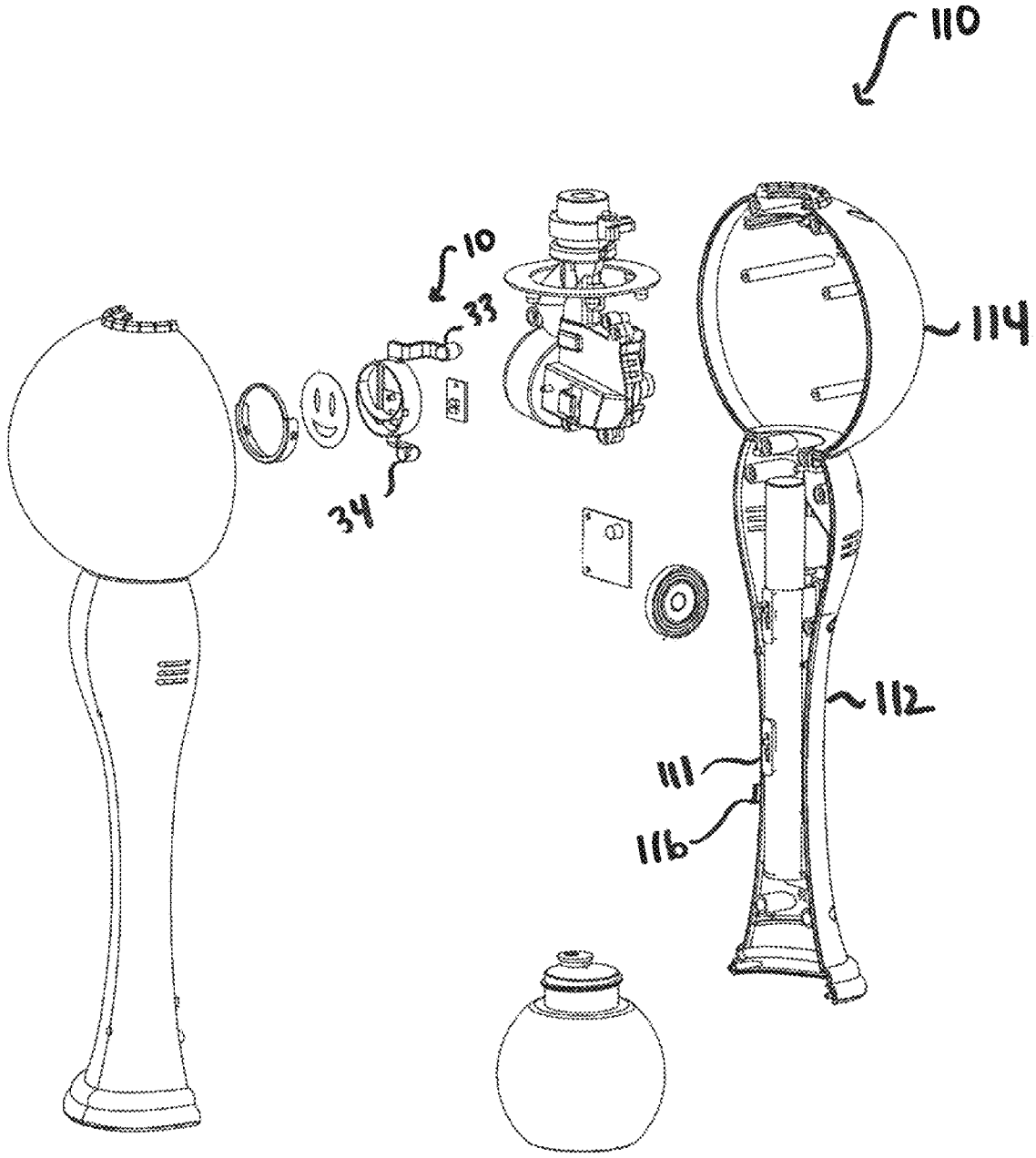
FIG. 6 is a side, perspective, exploded of the illuminating animation device of FIG. 1 securable within a bubble producing toy.

Moreover, as shown in FIG. 6, the device 10 is secured into a bubble producing toy 110. The bubble toy is like the bubble producing wand, which is made by Applicant and is disclosed in U.S. patent application Ser. No. 17/335,447, which application is incorporated by reference herein in its entirety. In this embodiment, there is for example, a three-way slide switch 111 behind a handle 112 to change the mode. When the switch turned to the right, bubbles are emitted out of the top of the toy and the device illuminates to create an animation that is projected onto an inner surface of a globular housing 114. There is a separate push button 116 beside the 3-way slide switch which plays and stops music. The mouth of the device animates and accompanies the music or in sync with the music. When the music stops, the light show returns to a preprogrammed light show. When the slide switch is turned to the left, other functions are activated, and the animation of the mouth is triggered by external soundwaves.

Figure 7:
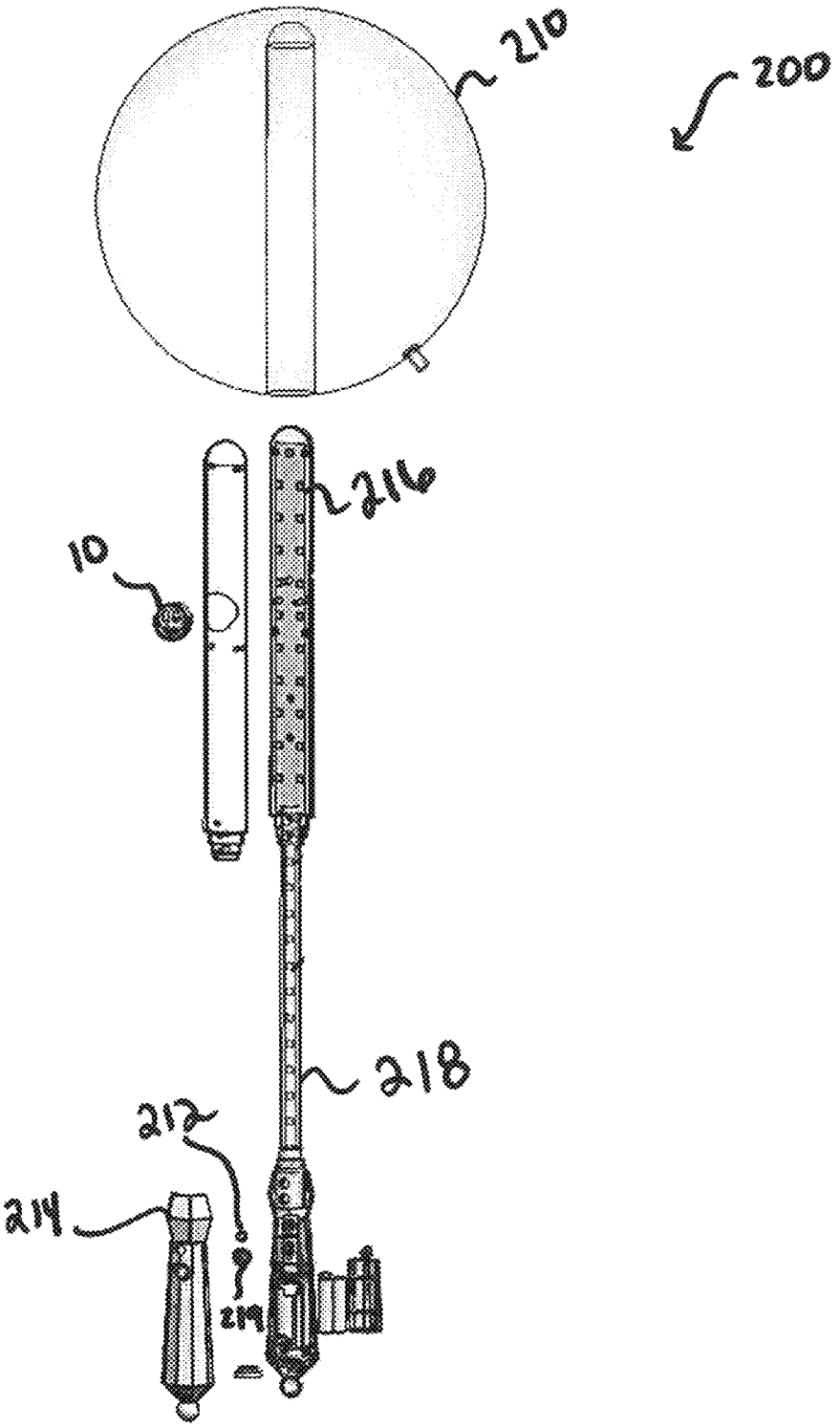
FIG. 7 is a side, perspective, exploded view of the illuminating animation device of FIG. 1 securable within an inflatable balloon toy.

Moreover, as shown in FIG. 7, the device 10 is secured into a balloon toy 200. In this embodiment, a back side of the inflatable balloon 210 is printed with foil or a reflective material, while a front side of the balloon is left blank to allow for precise projection of the animated images. A button 212 is located on a handle 214 of the toy. When this button is pressed, the light, sound, and projection features of the toy are automatically activated. Continuously pressing of the button cycles through six different light effects, projection and sound and automatically turn off after flashing all the different effects (see flow chart of FIG. 10). When the button is pressed for a certain amount of time, such as about 3 seconds, the mode changes, and the animation features deactivate, for example on the shaft 218 of the toy. Instead, various LEDS 216 light the inside the inflatable balloon illuminate the surface of the balloon. Continuously pressing of button changes the color and luminosity of the LEDs. After flashing the preprogrammed color sequence, the toy turns off automatically. Moreover, the handle includes an IR signal button 219, which sends an IR signal for a fixture or a toy.

Figure 8:
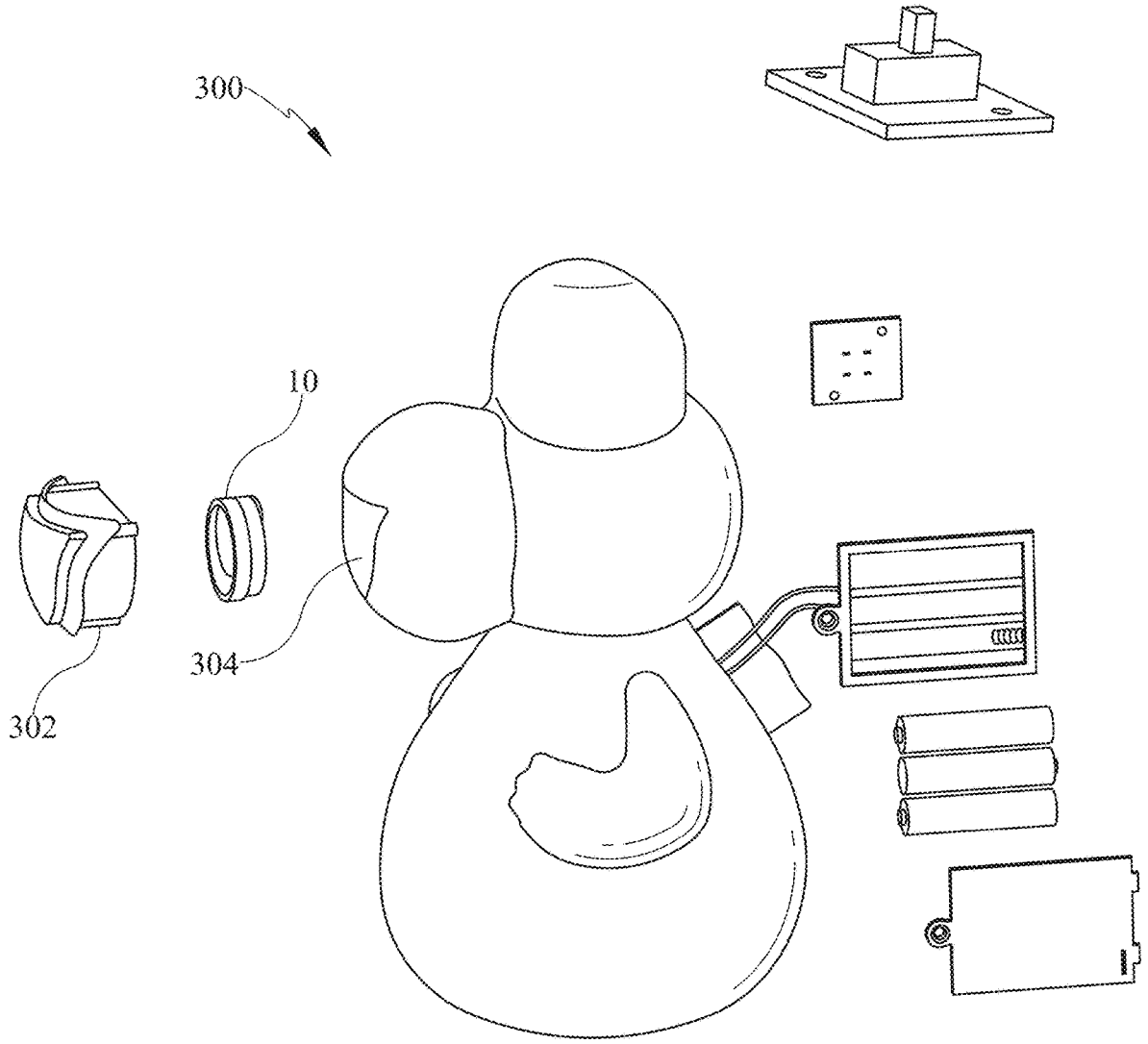
FIG. 8 is a side, partially exploded view of the illuminating animation device of FIG. 1 securable within a plush toy.

As shown in FIG. 8, the device 10 is securable into a plush toy 300. In this embodiment, the plush toy includes a projection box 302, which is a closed box that contains the animated device 10 and an image is stitched around the toy's projection opening. Further the plush toy includes a cutaway 304 on the plush toy into which the projection box is secured.

In one embodiment, the animation effect is created differently. For example, the film is a much thicker material, so that you can only see the mouth as a light. Accordingly, light is used to create shadows, which create the animation.

It is well recognized by persons skilled in the art that alternative embodiments to those disclosed herein, which are foreseeable alternatives, are also covered by this disclosure. The foregoing disclosure is not intended to be construed to limit the embodiments or otherwise to exclude such other embodiments, adaptations, variations, modifications and equivalent arrangements.

The invention claimed is:

1. An illuminating animation device comprising:

a housing comprising a base and a film secured together via a wall that extends therebetween, which forms a housing compartment, wherein the film includes an image cut therein;

a divider secured within the housing compartment, which divides the compartment into a first and second chamber;

a printed circuit board secured to the base within the compartment, wherein the printed circuit board comprises a first and second LED, wherein the first LED is secured within the first chamber and the second LED is secured within the second chamber;

a microcontroller unit secured to the base and electrically connected to the printed circuit board; and a power source electrically connected to the microcontroller unit;

wherein the image is a smiley face with a mouth and eyes, and the divider is curved to correspond with a u-shape of the mouth so that the eyes and an upper portion of the mouth are illuminated by the first LED and a lower portion of the mouth are illuminated by the second LED.

2. The device of claim 1, wherein a bracketing system is secured to an outside surface of the wall.

3. The device of claim 1, wherein the first LED is continuously illuminated when the device is powered on.

4. The device of claim 1, further comprising a speaker secured to the base and electrically connected to the microcontroller unit.

5. The device of claim 1, wherein the device is affixable to a lanyard.

6. The device of claim 1, further comprising at least one additional LED secured within the compartment and electrically connected to the microcontroller unit.

7. The device of claim 1, wherein the microcontroller unit further comprises a receiver for remote activation of the device.

8. The device of claim 1, wherein the microcontroller unit further comprises a microphone, wherein the illumination of the first and second LED are sound activated via the microphone.

9. An illuminating animation device comprising:

an enclosure comprising:

a housing secured therein comprising a base and a film secured together via a wall that extends therebetween, which forms a housing compartment, wherein the film includes an image cut therein;

a divider secured within the housing compartment, which divides the compartment into a first and second chamber;

a printed circuit board secured to the base within the compartment, wherein the printed circuit board comprises a first and second LED, wherein the first LED is secured within the first chamber and the second LED is secured within the second chamber;

a microcontroller unit secured to the base and electrically connected to the printed circuit board, wherein the microcontroller unit comprises a microphone and a switch; and a power source electrically connected to the microcontroller unit;

wherein the image is a smiley face with a mouth and eyes, and the divider is curved to correspond with a u-shape of the mouth so that the eyes and an upper portion of the mouth are illuminated by the first LED and a lower portion of the mouth are illuminated by the second LED.

10. The device of claim 9, wherein the opacity of the enclosure is about 50-80% opacity, preferably about 70% opacity.

11. The device of claim 9, wherein the first LED is continuously illuminated when the device is powered on.

12. The device of claim 9, further comprising a speaker electrically connected to the microcontroller unit, wherein the illumination of the first and second LED are sound activated via sound played from the speaker.

13. The device of claim 9, wherein the microcontroller unit further comprises a receiver for remote activation of the device.

14. The device of claim 9, further comprising at least one additional LED secured within the compartment and electrically connected to the microcontroller unit.

15. An illuminating animation device comprising:

an enclosure comprising:

a housing secured therein comprising a base and a film secured together via a wall that extends therebetween, which forms a housing compartment, wherein the film includes a smiley face image with a mouth and eyes cut therein;

a divider secured within the housing compartment, which divides the compartment into a first and second chamber;

a printed circuit board secured to the base within the compartment, wherein the printed circuit board comprises a first and second LED, wherein the first LED is secured within the first chamber and the second LED is secured within the second chamber, wherein the divider is curved to correspond with a u-shape of the mouth so that the eyes and an upper portion of the mouth are illuminated by the first LED and a lower portion of the mouth are illuminated by the second LED;

a microcontroller unit secured to the base and electrically connected to the printed circuit board, wherein the microcontroller unit comprises a microphone and a switch, wherein the illumination of the first and second LED are sound activated via the microphone;

a speaker electrically connected to the microcontroller unit; and a power source electrically connected to the microcontroller unit.

16. The device of claim 15, wherein the first LED is continuously illuminated when the device is powered on.

17. The device of claim 15, wherein the illumination of the first and second LED are also configured to be sound activated via sound played from the speaker.

18. The device of claim 15, further comprising at least one additional LED secured within the compartment and electrically connected to the microcontroller unit.

* * * * *